US012472552B1

(12) United States Patent
Zhang et al.

(10) Patent No.: US 12,472,552 B1
(45) Date of Patent: Nov. 18, 2025

(54) ELECTRO-HYDRAULIC RIVETING TOOL

(71) Applicant: MEISHAN CRRC FASTENING SYSTEM CO., LTD., Sichuan (CN)

(72) Inventors: Shuai Zhang, Sichuan (CN); Wei Li, Sichuan (CN); Long Guo, Sichuan (CN); Jun Mao, Sichuan (CN); MingYang Luo, Sichuan (CN); Zhiwei Hu, Sichuan (CN); XueHui Liao, Sichuan (CN); Deke Zhou, Sichuan (CN); Biao Li, Sichuan (CN); Shaoqing Guo, Sichuan (CN); Tao Yang, Sichuan (CN); Zheng Qiao, Sichuan (CN); Jin Peng, Sichuan (CN); Zongyang Zuo, Sichuan (CN)

(73) Assignee: MEISHAN CRRC FASTENING SYSTEM CO., LTD., Sichuan (CN)

( * ) Notice: Subject to any disclaimer, the term of this patent is extended or adjusted under 35 U.S.C. 154(b) by 0 days.

(21) Appl. No.: 19/180,462

(22) Filed: Apr. 16, 2025

Related U.S. Application Data

(63) Continuation of application No. PCT/CN2024/139438, filed on Dec. 14, 2024.

(30) Foreign Application Priority Data

Dec. 5, 2024 (CN) ..... 202422990396.0

(51) Int. Cl.
*B21J 15/10* (2006.01)
*B21J 15/20* (2006.01)
(Continued)

(52) U.S. Cl.
CPC ..... *B21J 15/105* (2013.01); *B21J 15/20* (2013.01); *B21J 15/26* (2013.01); *B21J 15/326* (2013.01)

(58) Field of Classification Search
CPC ..... B21J 15/105; B21J 15/20
See application file for complete search history.

(56) References Cited

U.S. PATENT DOCUMENTS 4,010,630 A * 3/1977 Davis, Jr. ..... B21J 15/20 72/453.17
5,579,641 A * 12/1996 Wilcox ..... B21J 15/22 72/391.2

(Continued)

FOREIGN PATENT DOCUMENTS

CN 115319009 A * 11/2022 ..... B21J 15/20
CN 218744663 U * 3/2023 ..... B21J 15/20

(Continued)

*Primary Examiner* — Jared O Brown
(74) *Attorney, Agent, or Firm* — NKL Law; Allen Xue

(57) ABSTRACT

An electro-hydraulic riveting tool has a riveting working head and a pump body. The riveting head consists of a cylinder block, a hollow piston shaft, and a rear end cover. The cylinder block and the rear end cover jointly define a hydraulic cavity. Inside the cylinder body, a first oil passage and a second oil passage are formed. On the pump body, a third oil passage and a fourth oil passage are provided. A broken-nail guide tube is coupled to the riveting working head. The rear end of the broken-nail guide tube is in communication with a nail-collecting box. An adapter plate is sleeved around the outer wall of the broken-nail guide tube. The adapter plate contains an intermediate oil passage with a first and a second intermediate oil passage. An accommodation groove is formed in the adapter plate, and a shock-absorbing joint is housed within this groove.

10 Claims, 7 Drawing Sheets

(51) Int. Cl.
*B21J 15/26* (2006.01)
*B21J 15/32* (2006.01)

(56) References Cited

U.S. PATENT DOCUMENTS

| | | | | | |
|---|---|---|---|---|---|
| 5,647,209 | A * | 7/1997 | Wilcox | ..... | B21J 15/22<br>72/391.2 |
| 6,684,470 | B1 * | 2/2004 | Joux | ..... | B21J 15/26<br>72/391.6 |
| 2011/0271504 | A1 * | 11/2011 | Preti | ..... | B21J 15/26<br>29/243.524 |

FOREIGN PATENT DOCUMENTS

| | | | | | |
|---|---|---|---|---|---|
| CN | 118188609 | A * | 6/2024 | ..... | B21J 15/20 |
| CN | 118305267 | A * | 7/2024 | ..... | B21J 15/20 |

* cited by examiner

ELECTRO-HYDRAULIC RIVETING TOOL

TECHNICAL FIELD

The present utility model relates to the technical field of the design of riveting devices, and particularly relates to an electro-hydraulic riveting tool.

BACKGROUND

An electro-hydraulic riveting device generally consists of an electric motor, an oil cylinder, a main body, and a riveting working head. During the running of the existing electro-hydraulic riveting device, the reciprocating movement of the riveting working head generates relatively large vibrations. When the vibrations generated by the riveting working head are transmitted to the pump body, the oil cylinder, and the electric motor, it is likely to affect the connection stability among the pump body, the oil cylinder, and the electric motor, leading to problems like bolt loosening, breakage, and structural damage. Such problems will impact the overall service life of the riveting device.

SUMMARY

An objective of the present utility model is to provide an electro-hydraulic riveting tool. The electro-hydraulic riveting tool according to the present utility model is capable of effectively reducing the vibration transferred from the riveting working head to other components such as the pump body, thereby extending the overall service life of the riveting device.

In order to address the aforementioned technical problems, the present utility model employs the following technical solutions:

An electro-hydraulic riveting tool comprises a riveting working head and a pump body. The riveting working head is composed of a cylinder body, a hollow piston shaft and a rear end cover. The cylinder body and the rear end cover jointly define a hydraulic cavity for the movable hollow piston shaft. The cylinder body is internally provided with a first oil passage for connecting with a front end of the hydraulic cavity and a second oil passage for connecting with a rear end of the hydraulic cavity. The pump body is furnished with a third oil passage for connecting with the first oil passage and a fourth oil passage for connecting with the second oil passage.

In the present utility model, a broken-nail guide tube is connected to the riveting working head. The rear end of the broken-nail guide tube is connected to a nail-collecting box. An adapter plate is coaxially sleeved on an outer wall of the broken-nail guide tube. An oil passage is formed within the adapter plate. The intermediate oil passages comprise a first intermediate oil passage for connecting with the first oil passage and the third oil passage, and a second intermediate oil passage for connecting with the second oil passage and the fourth oil passage. Within the adapter plate, there is an accommodation groove for connecting with the intermediate oil passage and parallel to the reciprocating motion direction of the riveting working head. A shock-absorbing joint is housed within the accommodation groove. Inside the shock-absorbing joint, there is an axial oil duct extending along the axial direction of the shock-absorbing joint and a radial oil duct extending along the radial direction of the shock-absorbing joint. The axial oil duct and the radial oil duct are interconnected. The axial oil duct is connected to either the first oil passage or the second oil passage. When the riveting working head is running, the length of the shock-absorbing joint within the accommodation groove is invariably less than the length of the accommodation groove, and the radial oil duct is always connected with the intermediate oil passage. Its function thereof is that, by virtue of the arrangement among the adapter plate, the accommodation groove, and the shock-absorbing joint, when the riveting working head generates axial reciprocating vibrations, these vibrations are transferred to the shock-absorbing joint. The shock-absorbing joint executes axial reciprocating motion within the accommodation groove, thereby preventing the vibrations of the shock-absorbing joint from being transferred to the adapter plate. As a result, the adapter plate is precluded from being influenced by the vibrations and then transmitting them to other components such as the pump body and the motor. This plays a role in enhancing the connection stability among various components within the riveting device and extending the overall service life of the riveting device. Regarding the provision of the broken-nail guide tube, during the operation of the riveting working head, it enables the discharge and collection of broken nails. Meanwhile, the broken-nail guide tube can perform the function of positioning the adapter plate, and the adapter plate can serve as a guide for the broken-nail guide tube.

Furthermore, the first intermediate oil passage comprises a third oil passage for connecting with the third oil-passing port, and the second intermediate oil passage comprises a fourth oil-passing port for connecting with the fourth oil passage. The axial oil duct is disposed at the front end of the adapter plate, and the third oil-passing port and the fourth oil-passing port are disposed at the rear end of the adapter plate. The distances from both the third oil-passing port and the fourth oil-passing port to the plane where the axes of the two axial oil ducts lie are each greater than zero. The function thereof is that, by virtue of the spatial relationship between the third oil-passing port and the fourth oil-passing port as well as the axial oil duct, it facilitates the staggered arrangement of the riveting working head and the pump body, thereby preventing the direct transmission of vibrations from the riveting working head to the pump body.

Furthermore, the cylinder body is connected to an oil distributing plate in a sealed manner. The end-face of the shock-absorbing joint facing the cylinder body is provided with a limiting outer rim. The opening of the axial oil duct is disposed on the end-face of the limiting outer rim. On the side of the oil distributing plate opposite to the adapter plate, a limiting groove for accommodating the limiting outer rim is provided. The function thereof is that, by virtue of the arrangement of the limiting outer rim and the limiting groove, the shock-absorbing joint can be fixed between the oil distributing plate and the cylinder body.

Furthermore, at the end of the shock-absorbing joint opposite to the limiting outer rim, a sealed end-piece is provided. The sealed end piece has an interference fit with the accommodation groove, and the radial oil duct is disposed between the sealed end-piece and the limiting outer rim. The function thereof is that, by virtue of the provision of the sealed end-piece and the design of the dimensional relationship between the sealed end piece and the accommodation groove, the overflow of liquid from the accommodation groove can be precluded.

Furthermore, at the radial oil duct opening on the shock-absorbing joint sidewall, ring-shaped sealing grooves are placed for accommodating sealing rings on both the front and rear axial sides of the shock-absorbing joint. Sealing grooves for receiving sealing rings are provided between the radial oil duct and the sealed end piece as well as between the radial oil duct and the limiting outer rim. The sealing ring is a commonly-known prior art, and thus will not be elaborated further. The function thereof is that, by virtue of the provision of the sealing grooves, sealing rings with an interference fit with the accommodation groove can be placed in these grooves. This serves to enhance the sealing effect on both the front and rear sides of the axial oil duct. Consequently, during the running of the riveting working head, the radial oil duct remains in a state of continuous connection with the intermediate oil passage, and the intermediate oil passage is constantly located between the two sealing rings within the accommodation groove.

Furthermore, the broken-nail guide tube is arranged coaxially with the hollow piston shaft. On the outer wall of the broken-nail guide tube, there is a blocking plate for sealing the rear end of the rear end cover. The broken-nail guide tube has a buffering section close to the blocking plate, for the buffer structure to be sleeved on. At the end of the buffering section away from the blocking plate, there is an annular groove for inserting an annular retaining ring. When the adapter plate is mounted on the broken-nail guide tube, it is positioned at the midpoint of the buffering section. Buffer structures are disposed between the adapter plate and the blocking plate as well as between the adapter plate and the annular groove. The function thereof is that, by virtue of the provision of the buffer structure, a buffering effect between the riveting working head and the adapter plate can be achieved. When the riveting working head experiences reciprocating vibrations, the broken-nail guide tube is actuated to generate vibrations in the front-rear direction. The buffer structures, one between the adapter plate and the blocking plate and the other between the annular retaining ring and the adapter plate, cushion and mitigate the front-rear vibrations of the broken-nail guide tube.

Furthermore, the buffer structure comprises elastic gaskets and elastic rings arranged at intervals. The elastic gasket has a rectangular cross-section, while the elastic ring has a circular cross-section. The function thereof is that, by virtue of the design of arranging different-shaped buffer structures at intervals, the elastic rings can expand and deform outward when extruded, thus changing the vibration direction from the axial to the radial direction. The elastic gaskets serve to provide a certain degree of support to the elastic rings. By arranging multiple elastic rings and elastic gaskets at intervals, an optimal shock-absorption effect can be achieved without the need for large outer-diameter elastic rings that would take up too much space.

Furthermore, proximate to the nail-collecting box side of the pump body, a support frame is disposed for supporting the broken-nail guide rod.

Furthermore, the adapter plate has a front guide ring for the broken-nail guide tube to pass through. The inner diameter of the front guide ring is equivalent to the outer diameter of the buffering section. The support frame has a rear guide ring for the broken-nail guide tube to pass through. The inner diameter of the rear guide ring is identical to the outer diameter of the broken-nail guide tube, while the outer diameter of the buffering section is greater than that of the broken-nail guide tube. The function thereof is that, by virtue of the provision of the front guide ring and the rear guide ring, the outer wall of the broken-nail guide tube can be fixed.

Furthermore, an end-face protective sleeve is disposed on the end-face of the broken-nail guide tube facing the nail-collecting box. The function thereof is that, by virtue of the provision of the end-face protective sleeve, it enables to protect the end-face of the broken-nail guide tube within the nail-collecting box.

The present utility model has the following beneficial effects:

The present utility model of the electro-hydraulic riveting tool is furnished with an adapter plate, a receiving groove, and a shock-absorbing joint. When the riveting working head experiences axial reciprocating vibrations, the vibrations are initially transmitted to the shock-absorbing joint. The shock-absorbing joint conducts axial reciprocating motion within the accommodation groove, thereby averting the transmission of the shock-absorbing joint's vibrations to the adapter plate. Consequently, the adapter plate is shielded from vibrations and from relaying vibrations to other components like the pump body and the motor. This effectively contributes to augmenting the connection stability of diverse components within the riveting device and prolonging the overall service life of the riveting device.

By virtue of the arrangement of the broken-nail guide tube, during the running of the riveting working head, it enables to discharge and collect broken nails. Simultaneously, the broken-nail guide tube is capable of fulfilling a positioning function for the adapter plate, while the adapter plate can function as a guide for the broken-nail guide tube.

By virtue of the spatial relationship between the third oil-passing port and the fourth oil-passing port as well as the axial oil duct, it facilitates the staggered arrangement of the riveting working head and the pump body, thereby preventing the direct transmission of vibrations from the riveting working head to the pump body.

By virtue of the provision of the sealing grooves, sealing rings with an interference fit with the accommodation groove can be placed in these grooves. This serves to enhance the sealing effect on both the front and rear sides of the axial oil duct. Consequently, during the running of the riveting working head, the radial oil duct remains in a state of continuous connection with the intermediate oil passage, and the intermediate oil passage is constantly located between the two sealing rings within the accommodation groove.

By virtue of the design of arranging different-shaped buffer structures at intervals, the elastic rings can expand and deform outward when extruded, thus changing the vibration direction from the axial to the radial direction. The elastic gaskets serve to provide a certain degree of support to the elastic rings. By arranging multiple elastic rings and elastic gaskets at intervals, an optimal shock-absorption effect can be achieved without the need for large outer-diameter elastic rings that would take up too much space.

Figure 1:
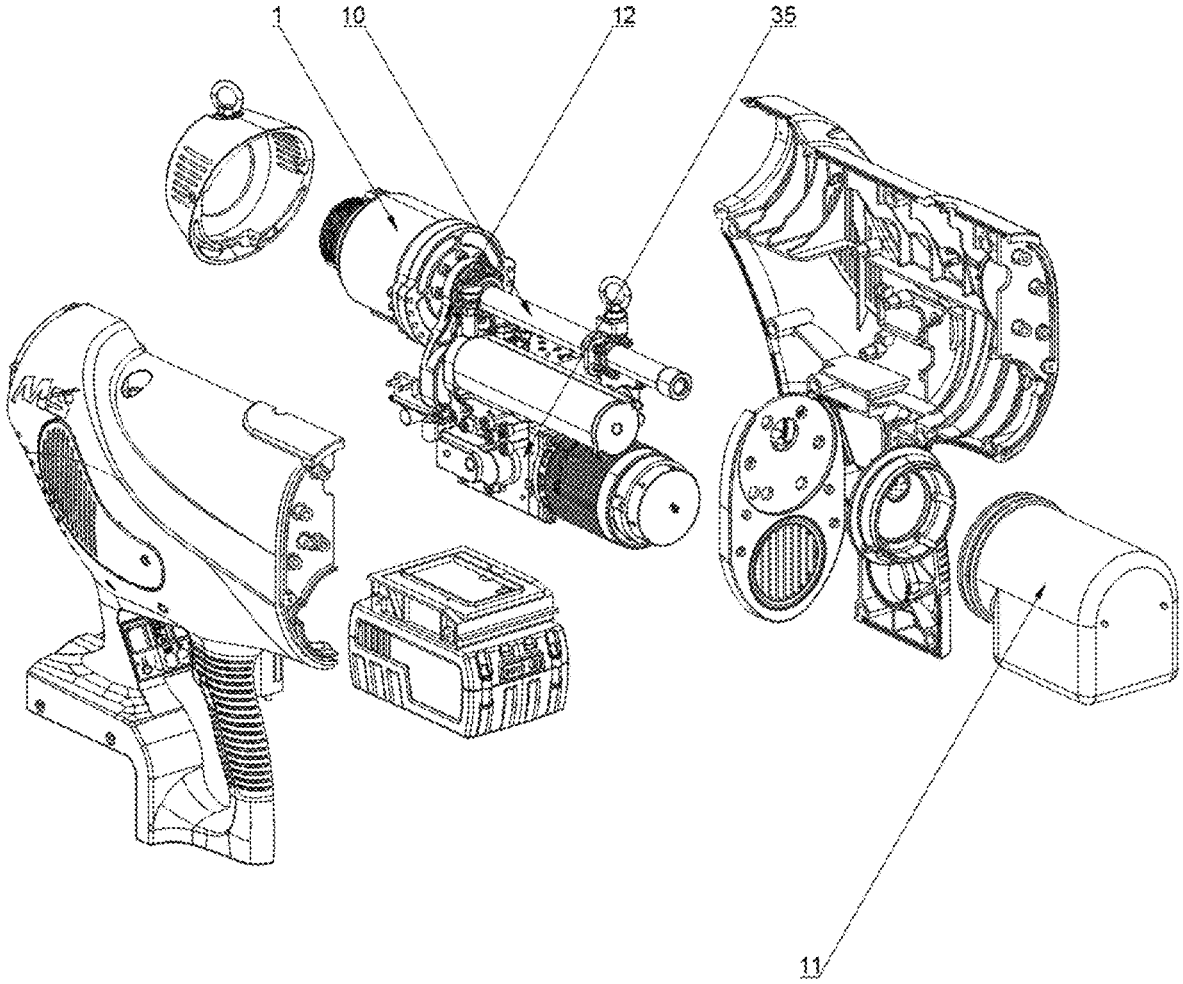
FIG. 1 is a schematic diagram of a three-dimensional explosive structure according to a riveting tool embodiment.

Reference numerals in the accompanying drawings: 1. Riveting working head; 2. Cylinder body; 3. Hollow piston shaft; 4. Rear end cover; 5. Hydraulic cavity; 6. First oil passage; 7. Second oil passage; 8. Third oil passage; 9. Fouth oil passage; 10. Broken-nail guide tube; 11. Nail-collecting box; 12. Adapter plate; 13. First intermediate oil passage; 14. Second intermediate oil passage; 15. accommodation groove; 16. Shock-absorbing joint; 17. Axial oil duct; 18. Radial oil duct; 19. Third oil-passing port; 20. Fourth oil-passing port; 21. Oil distributing plate; 22. Limiting outer rim; 23. Limiting groove; 24. Sealed end piece; 25. Sealing groove; 26. Blocking plate; 27. Buffering section; 28. Annular groove; 29. Elastic gasket; 30. Elastic ring; 31. Support frame; 32. Front guide ring; 33. Rear guide ring; 34. End-face protective sleeve; 35. Pump body.

DETAILED DESCRIPTION OF THE EMBODIMENTS

The present utility model will be further described below in conjunction with the detailed description. The detailed description is a further explanation of the principle of the present utility model, and does not limit the present utility model in any way. The same or similar technology as the present utility model does not exceed the scope of protection of the present utility model.

Embodiment

As shown in FIG. 1, the electro-hydraulic riveting tool of the present embodiment comprises a riveting working head 1 and a pump body 35.

Figure 2:
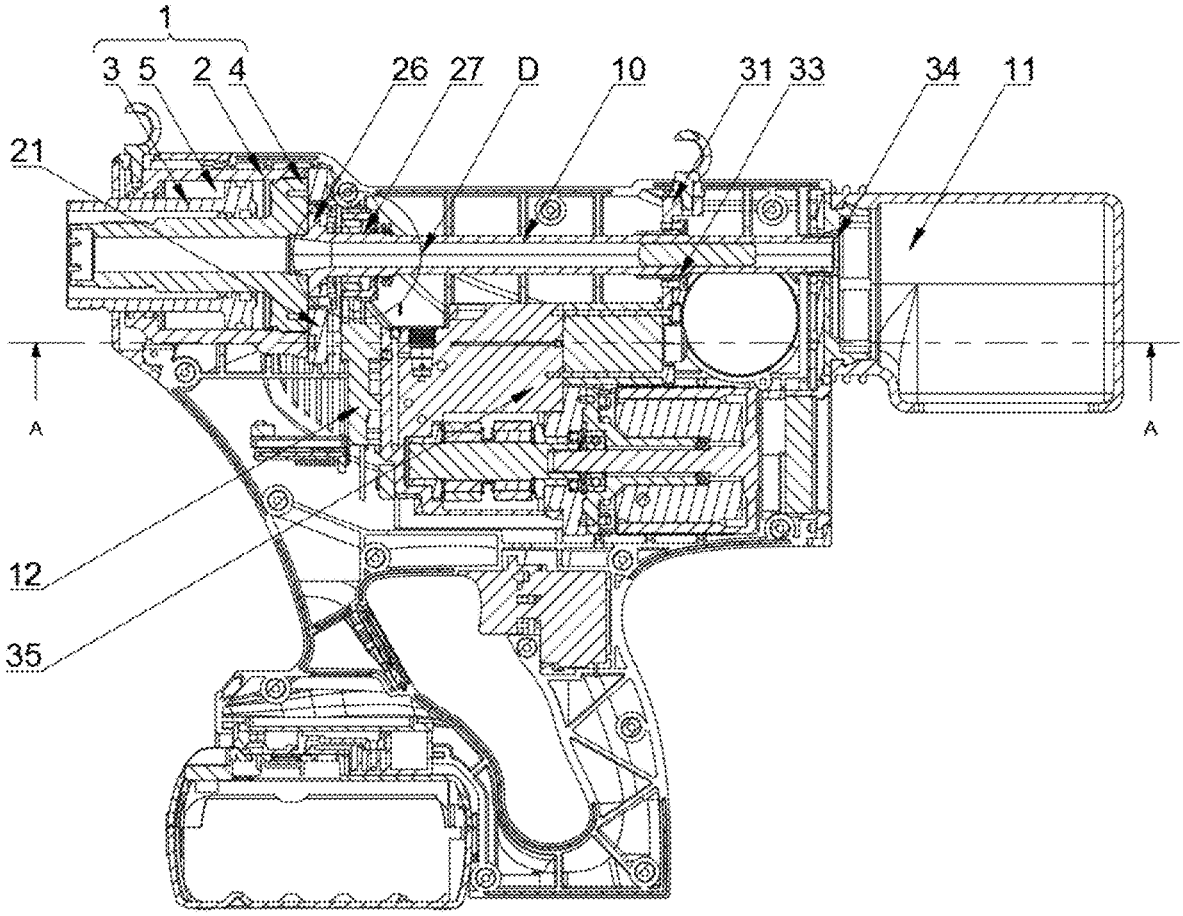
FIG. 2 is schematic diagram of a sectionalized structure along an axis of a riveting working head according to a riveting tool embodiment.
Figure 3:
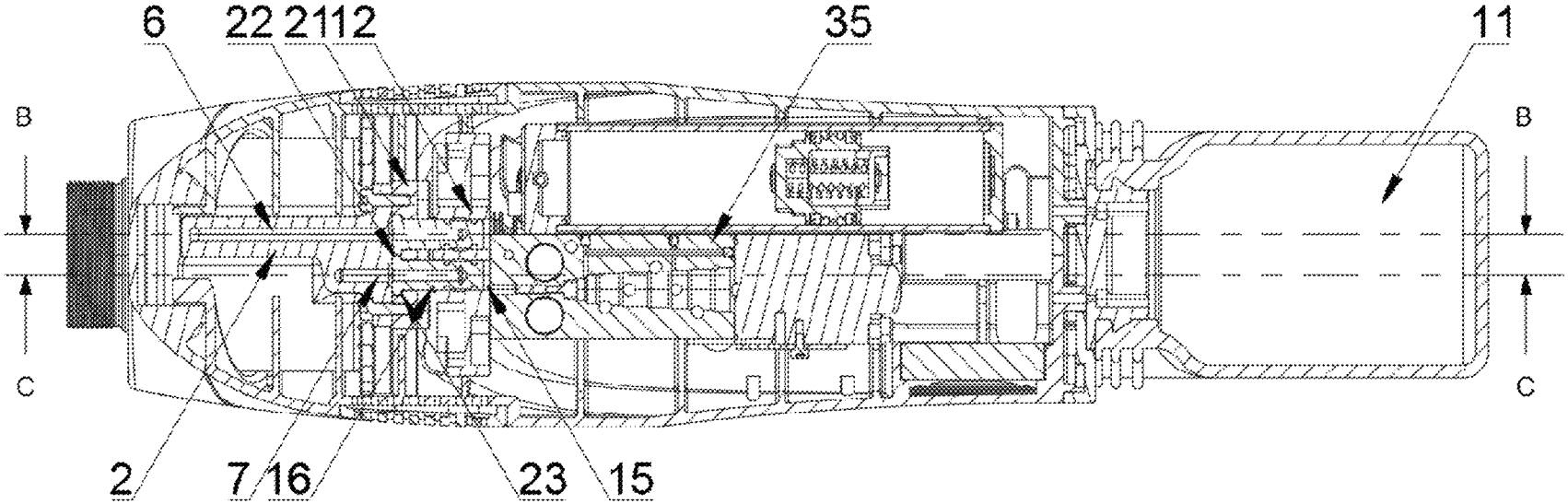
FIG. 3 is a schematic diagram of a sectionalized structure at A in FIG. 2.
Figure 4:
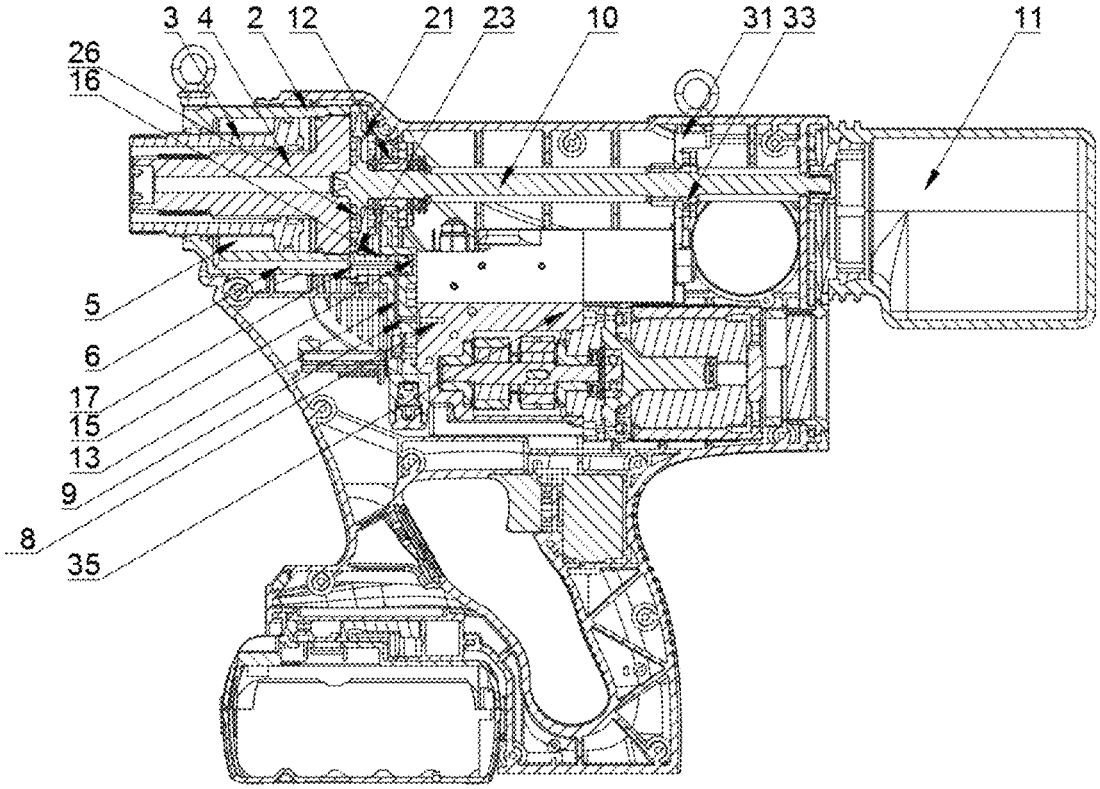
FIG. 4 is a schematic diagram of a sectionalized structure at B in FIG. 3.
Figure 5:
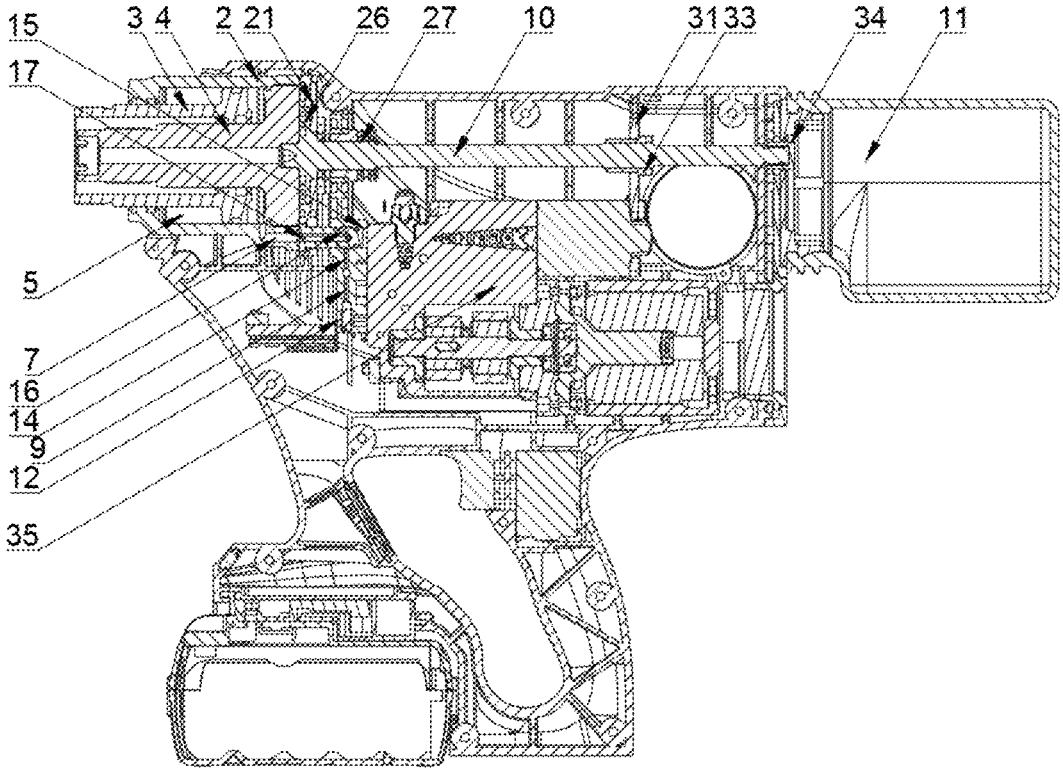
FIG. 5 is a schematic diagram of a sectionalized structure at at C in FIG. 3.

As shown in FIG. 2, the riveting working head 1 comprises a cylinder body 2, a hollow piston shaft 3, and a rear end cover 4. The cylinder body 2 and the rear end cover 4 jointly define a hydraulic cavity 5 for allowing the hollow piston shaft 3 to move. As shown in FIG. 3, the cylinder body 2 is internally provided with a first oil passage 6 for connecting with the front end of the hydraulic cavity 5 and a second oil passage 7 for connecting with the rear end of the hydraulic cavity 5. As shown in FIGS. 4 and 5, the pump body 35 is equipped with a third oil passage 8 for connecting with the first oil passage 6 and a fourth oil passage 9 for connecting with the second oil passage 7. The riveting working head 1 is connected to a broken-nail guide tube 10. The rear end of the broken-nail guide tube is connected with a nail-collecting box 11. An adapter plate 12 is sleeved on the outer wall of the broken-nail guide tube 10. Inside the adapter plate 12, there are intermediate oil passages. These intermediate oil passages include a first intermediate oil passage 13 for connection between the first oil passage 6 and the third oil passage 8, and a second intermediate oil passage 14 for connection between the second oil passage 7 and the fourth oil passage 9. The adapter plate 12 is provided with an accommodation groove 15 for connecting with the intermediate oil passages and is parallel to the reciprocating direction of the riveting working head 1. A shock-absorbing joint 16 is disposed within the accommodation groove 15. The shock-absorbing joint 16 features an axial oil duct 17 extending axially along the shock-absorbing joint 16 and a radial oil duct 18 extending radially along the shock-absorbing joint 16. The axial oil duct 17 and the radial oil duct 18 are connected with each other. The axial oil duct 17 is connected with either the first oil passage 6 or the second oil passage 7. When the riveting working head 1 is running, the length of the shock-absorbing joint 16 within the accommodation groove 15 is always shorter than that of the accommodation groove 15, and the radial oil duct 18 remains in continuous connection with the intermediate oil passages. The pump body 35, oil cylinder, and motor are of commonly-used prior art and thus will not be elaborated further. Its function thereof is that, by virtue of the arrangement among the adapter plate 12, the accommodation groove 15, and the shock-absorbing joint 16, when the riveting working head 1 generates axial reciprocating vibrations, these vibrations are transferred to the shock-absorbing joint 16. The shock-absorbing joint 16 executes axial reciprocating motion within the accommodation groove 15, thereby preventing the vibrations of the shock-absorbing joint 16 from being transferred to the adapter plate 12. As a result, the adapter plate 12 is precluded from being influenced by the vibrations and then transmitting them to other components such as the pump body 35 and the motor. This plays a role in enhancing the connection stability among various components within the riveting device and extending the overall service life of the riveting device. Regarding the provision of the broken-nail guide tube 10, during the running of the riveting working head 1, it enables the discharge and collection of broken nails. Meanwhile, the broken-nail guide tube 10 can perform the function of positioning the adapter plate 12, and the adapter plate 12 can serve as a guide for the broken-nail guide tube 10.

Figure 7:
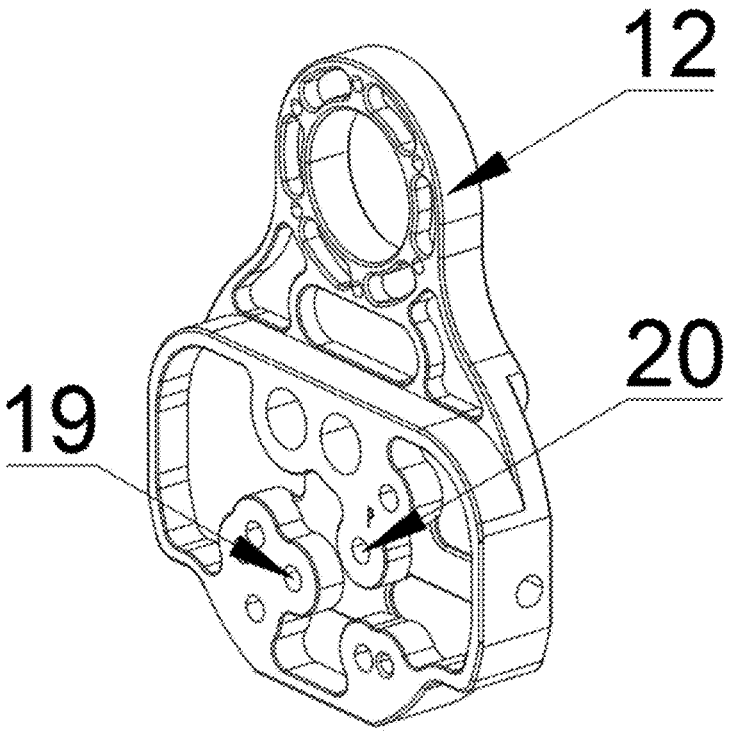
FIG. 7 is a schematic diagram of a three-dimensional structure of an adapter plate according to a riveting tool embodiment.
Figure 8:
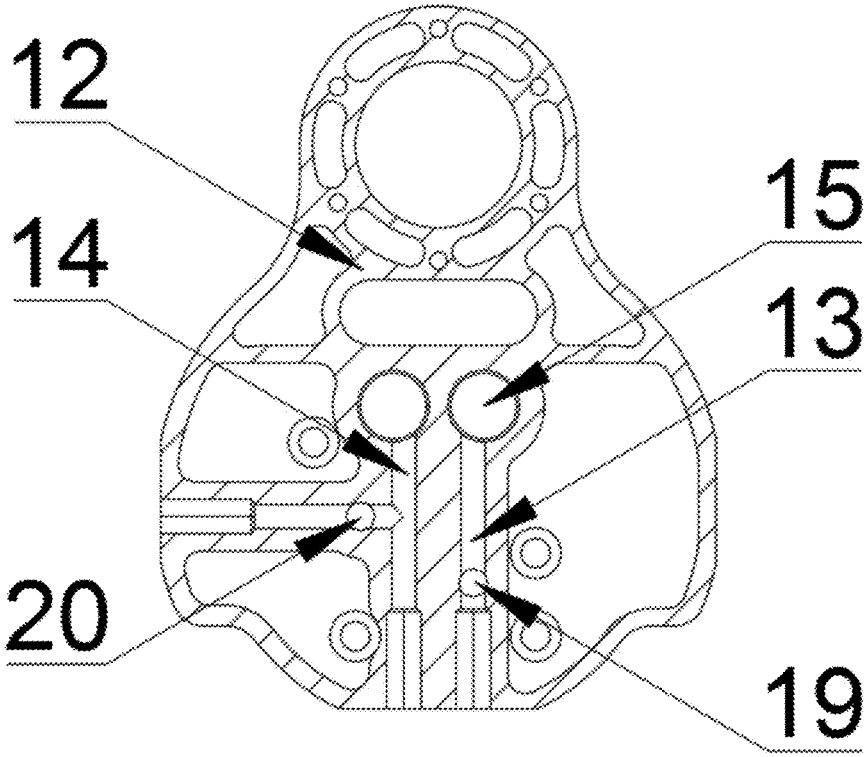
FIG. 8 is a schematic diagram of a sectionalized structure of an adapter plate of a riveting tool along an axis of a third intermediate oil passage according to a riveting tool embodiment.

As shown in FIG. 7, the first intermediate oil passage 13 comprises a third oil-passing port 19 for connecting with the third oil passage 8. The second intermediate oil passage 14 comprises a fourth oil-passing port 20 for connecting with the fourth oil passage 9. The axial oil ducts 17 are disposed at the front end of the adapter plate 12, while the third oil-passing port 19 and the fourth oil-passing port 20 are arranged at the rear end of the adapter plate 12. As shown in FIG. 8, the distances between the third oil-passing port 19 and the fourth oil-passing port 20 and the plane containing the axes of the two axial oil ducts 17 are each greater than zero. The function thereof is that, by virtue of the spatial relationship between the third oil-passing port 19 and the fourth oil-passing port 20 as well as the axial oil duct 17, it facilitates the staggered arrangement of the riveting working head 1 and the pump body 35, thereby preventing the direct transmission of vibrations from the riveting working head 1 to the pump body 35.

Figure 9:
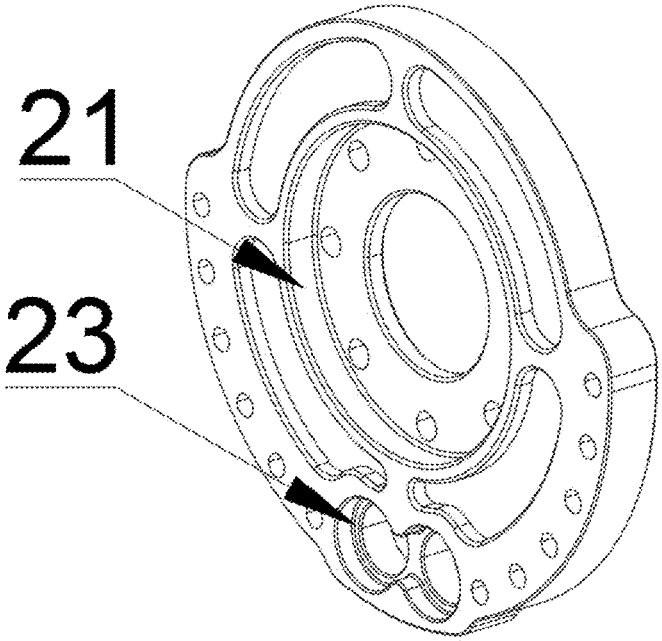
FIG. 9 is a schematic diagram of a sectionalized structure of an oil distributing plate according to a riveting tool embodiment.

As shown in FIG. 2 and FIG. 9, the cylinder body 2 is coupled to an oil distributing plate 21 in a sealed manner. A limiting outer rim 22 is provided on the end face of the shock-absorbing joint 16 facing the cylinder body 2. The opening of the axial oil duct 17 is located on the end face of the limiting outer rim 22. A limiting groove 23 for accommodating the limiting outer rim 22, is formed on the side of the oil distributing plate 21 opposite to the adapter plate 12. The function thereof is that, by virtue of the arrangement of the limiting outer rim 22 and the limiting groove 23, the shock-absorbing joint 16 can be fixed between the oil distributing plate 21 and the cylinder body 2.

Figure 10:
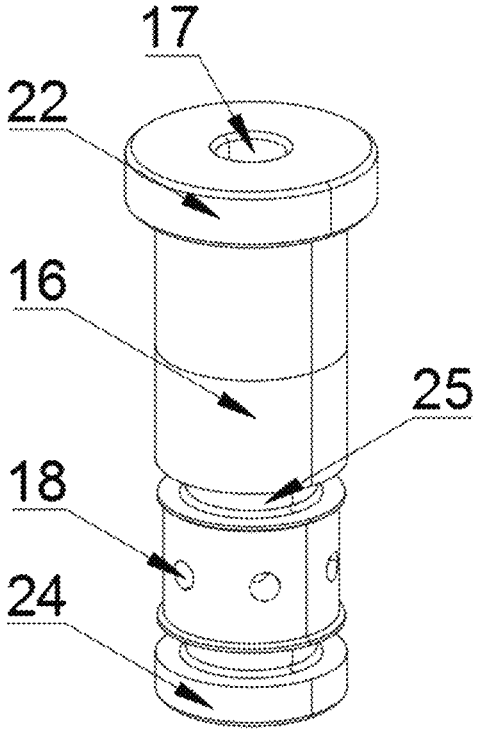
FIG. 10 is a schematic diagram of a sectionalized structure of a shock-absorbing joint according to a riveting tool embodiment.

As shown in FIG. 10, the end of the shock-absorbing joint 16 opposite to the limiting outer rim 22 is provided with a sealed end piece 24. The sealed end piece 24 is in an interference fit with the accommodation groove 15. The radial oil duct 18 is arranged between the sealed end piece 24 and the limiting outer rim 22. The function thereof is that, by virtue of the provision of the sealed end piece 24 and the design of the dimensional relationship between the sealed end piece 24 and the accommodation groove 15, the overflow of liquid from the accommodation groove 15 can be precluded.

As shown in FIG. 10, at the radial oil duct 18 opening on the shock-absorbing joint 16 sidewall, annular sealing grooves 25 for placing sealing rings are provided on both the front and rear axial sides of the shock-absorbing joint 16. Sealing grooves 25 for receiving sealing rings are provided between the radial oil duct 18 and the sealed end piece 24, as well as between the radial oil duct 18 and the limiting outer rim 22. The sealing ring is a commonly-known prior art, and thus will not be elaborated further. The function thereof is that, by virtue of the provision of the sealing grooves 25, sealing rings with an interference fit to the accommodation groove 15 can be placed in the sealing grooves 25. This serves to enhance the sealing effect on both the front and rear sides of the axial oil duct 17. Consequently, during the operation of the riveting working head 1, the radial oil duct 18 remains in a state of continuous connection with the intermediate oil passage, and the intermediate oil passage is constantly located between the two sealing rings within the accommodation groove 15.

As shown in FIG. 2, the broken-nail guide tube 10 is coaxially disposed with the hollow piston shaft 3. A blocking plate 26 for sealing the rear end of the rear end cover 4, is provided on the outer wall of the broken-nail guide tube 10. A buffering section 27 for receiving the buffer structure, is provided on the broken-nail guide tube 10 adjacent to the blocking plate 26. At the end of the buffering section 27 distal from the blocking plate 26, an annular groove 28 is formed to accommodate an annular retaining ring. When the adapter plate 12 is mounted on the broken-nail guide tube 10, it is positioned at the middle of the buffering section 27. Buffer structures are arranged both between the adapter plate 12 and the blocking plate 26 as well as between the adapter plate 12 and the annular groove 28. The function thereof is that, by virtue of the provision of the buffer structure, a buffering effect between the riveting working head 1 and the adapter plate 12 can be achieved. When the riveting working head 1 experiences reciprocating vibrations, the broken-nail guide tube 10 is actuated to generate vibrations in the front-rear direction. The buffer structures, one between adapter plate 12 and the blocking plate 26 and the other between the annular retaining ring and the adapter plate 12, cushion and mitigate the front-rear vibrations of the broken-nail guide tube 10.

Figure 6:
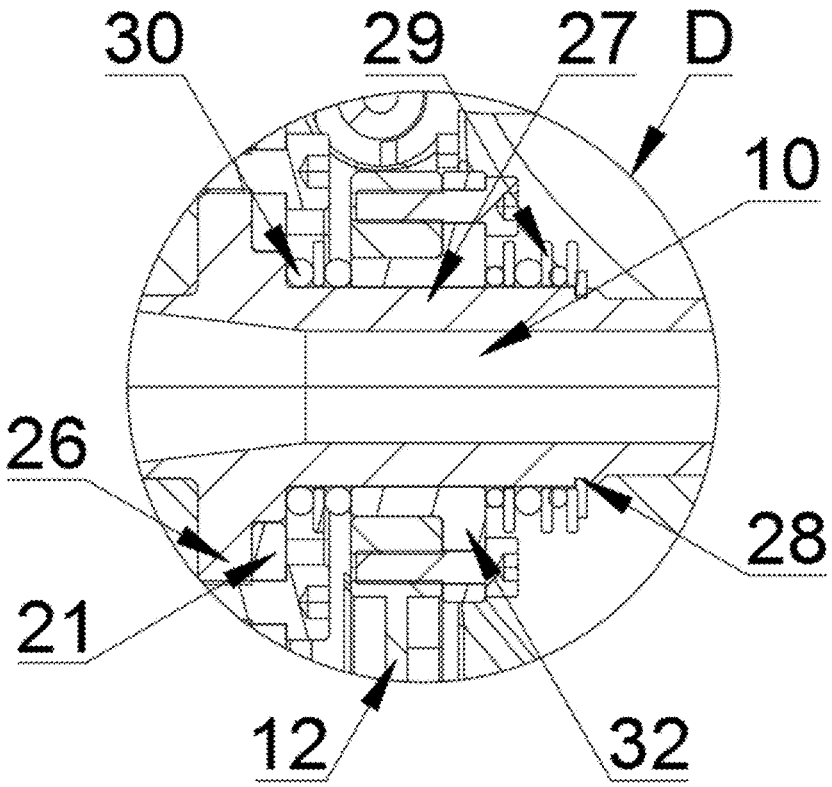
FIG. 6 is a schematic diagram of an amplified structure at at D in FIG. 2.

As shown in FIG. 6, the buffer structure comprises an elastic gasket 29 and an elastic ring 30 arranged at intervals. The elastic gasket 29 has a rectangular cross-section, while the elastic ring 30 has a circular cross-section. The function thereof is that, by virtue of the design of arranging different-shaped buffer structures at intervals, the elastic rings 30 can expand and deform outward when extruded, thus changing the vibration direction from the axial to the radial direction. The elastic gaskets 29 serve to provide a certain degree of support to the elastic rings 30. By arranging multiple elastic rings 30 and elastic gaskets 29 at intervals, an optimal shock-absorption effect can be achieved without the need for large outer-diameter elastic rings 30 that would take up too much space.

As shown in FIG. 2, a support frame 31 for supporting the broken-nail guide rod, is provided on the pump body 35 at a side adjacent to the nail-collecting box 11.

As shown in FIG. 2, the adapter plate 12 is provided with a front guide ring 32 for allowing the passage of the broken nail guide tube 10. The inner diameter of the front guide ring 32 is equal to the outer diameter of the buffering section 27. The support frame 31 is furnished with a rear guide ring 33 for allowing the broken-nail guide tube 10 to pass through. The inner diameter of the rear guide ring 33 is equal to the outer diameter of the broken-nail guide tube 10. Moreover, the outer diameter of the buffering section 27 is greater than that of the broken-nail guide tube 10. The function thereof is that, by virtue of the provision of the front guide ring 32 and the rear guide ring 33, the outer wall of the broken-nail guide tube 10 can be fixed.

As shown in FIG. 2, an end-face protective sleeve 34 is disposed on the end face of the broken-nail guide tube 10 facing the nail-collecting box 11. The end-face protective sleeve 34 is coupled to the distal end of the broken-nail guide tube 10 in a threaded connection. This coupling effectively seals the end face of the broken-nail guide tube 10. The end-face protective sleeve 34 is configured as a hollow of revolution with an L-shaped cross-section. The purpose of the end-face protective sleeve 34 is to safeguard the end face of the broken-nail guide tube 10 within the nail-collecting box 11. Specifically, the provision of the end-face protective sleeve 34 serves to shield the aforesaid end face from potential damage or wear.

The working principle of the present embodiment is elucidated as follows: In the present embodiment, energy is primarily supplied by the battery. A motor is employed to effect the conversion of electrical energy into mechanical energy. Subsequently, the motor drives the pump body to convey pressurized hydraulic fluid to the working head. The pump body is furnished with an oil tank for isolating the external environment from the hydraulic oil and is dedicated to supplying the requisite hydraulic fluid to the pump body. A pressure sensor and a directional control valve are installed on the main oil passage of the pump body. The main controller regulates the motor and the directional control valve in accordance with the hydraulic fluid pressure relayed by the pressure sensor. This regulation propels the piston of the working head to execute a controlled reciprocating motion in line with the requirements of the riveting process, thereby accomplishing the riveting operation. To augment the reliability and operational efficiency of the tool, the hydraulic system further incorporates components such as a low-pressure bypass valve, a high-pressure safety valve, and an oil-tank pressure safety valve. The tool is equipped with a display screen for presenting working parameters, and these parameters can be configured via the parameter-setting buttons.

During the operation of the riveting working head 1, axial vibrations are induced. A fraction of the vibrations generated by the riveting working head 1 is transferred to the broken-nail guide tube 10. Subsequently, these vibrations are transmitted from the broken-nail guide tube 10 to the buffer structures at the front and rear extremities of the adapter plate 12 for alleviation. Another fraction of the vibrations stemming from the riveting working head 1 is conveyed to the shock-absorbing joint 16. This causes the shock-absorbing joint 16 to undergo reciprocal vibrations in tandem with the riveting working head 1. Significantly, the vibrations of the shock-absorbing joint 16 are not transmitted to the adapter plate 12, thereby achieving an outstanding shock-absorption performance.

The above-mentioned embodiments are only preferred embodiments of the present utility model and are not restricted thereto in any way. Any simple modification, equivalent replacement and alteration made to these embodiments based on the technical essence of the present utility model fall within the protection scope of the technical solutions of the present utility model.

In the description of the present utility model, it is to be noted that terms such as "center", "upward", "downward", "left", "right", "vertical", "longitudinal", "lateral", "horizontal", "inner", "outer", "front", "rear", "top", "bottom" etc. denote orientations or positional relationships based on those shown in the accompanying drawings, or the orientations or positional relationships in which the product of the present utility model is customarily positioned during use. These are merely for the convenience of describing the present utility model and simplifying the description, and do not imply or suggest that the device or element in question must possess a particular orientation, be constructed and operate in a specific orientation. As such, they shall not be construed as limitations to the present utility model.

In the description of the present utility model, it should also be noted that, unless otherwise expressly specified and limited, the terms "furnished", "provided", "installed", "interconnected", "connected" should be understood in a broad sense, e.g., it can be a fixed connection, a removable connection, or a connection in one piece; it can be a mechanical connection or an electrical connection; it can be a direct connection or an indirect connection through an intermediate medium, or it can be a connection within two elements. It may be a connection within two elements. For those of ordinary skill in the art, the specific implications of the above terms in the present utility model may be understood in specific cases.

The invention claimed is:

1. An electro-hydraulic riveting tool, comprising a riveting working head (1) and a pump body (35), wherein the riveting working head (1) is composed of a cylinder body (2), a hollow piston shaft (3) and a rear end cover (4); the cylinder body (2) and the rear end cover (4) jointly define a hydraulic cavity (5) for the movable hollow piston shaft (3); the cylinder body (2) is internally provided with a first oil passage (6) for connecting with a front end of the hydraulic cavity (5) and a second oil passage (7) for connecting with a rear end of the hydraulic cavity (5); the pump body (35) is furnished with a third oil passage (8) for connecting with the first oil passage (6) and a fourth oil passage for connecting with the second oil passage (7), wherein in that, the riveting working head (1) is communicatively provided with a broken-nail guide tube (10); a rear end of the broken-nail guide tube (10) is connected with a nail-collecting box (11); an adapter plate (12) is sleeved on the outer wall of the broken-nail guide tube (10); an oil passage is formed within the adapter plate (12); the oil passage of the adapter plate comprises a first intermediate oil passage (13) for connection between the first oil passage (6) and the third oil passage (8), and a second intermediate oil passage (14) for connection between the second oil passage (7) and the fourth oil passage; the adapter plate (12) has an accommodation groove (15) inside, connecting with the oil passage of the adapter plate and parallel to the reciprocating movement direction of the riveting working head (1); a shock-absorbing joint (16) is disposed within the accommodation groove (15); inside the shock-absorbing joint (16), there is an axial oil duct (17) extending axially along the shock-absorbing joint (16) and a radial oil-duct (18) extending radially along the shock-absorbing joint (16); the axial oil duct (17) is in fluid communication with the radial oil duct (18), and the axial oil duct (17) is connected with either the first oil passage (6) or the second oil passage (7); when the riveting working head (1) is running, a length of the shock-absorbing joint (16) within the accommodation groove (15) is always less than that of the accommodation groove (15), and the radial oil duct (18) remains connected with the oil passage of the adapter plate at all times.

2. The electro-hydraulic riveting tool according to claim 1, wherein the first intermediate oil passage (13) comprises a third oil-passing port (19) for connection with the third oil passage (8), and the second intermediate oil passage (14) comprises a fourth oil-passing port (20) for connection with the fourth oil passage; the axial oil duct (17) is arranged at a front end of the adapter plate (12), while the third oil-passing port and the fourth oil-passing port (20) are arranged at a rear end of the adapter plate (12); distances between the third oil-passing port (19), the fourth oil-passing port (20) and a plane where an axis of the axial oil duct (17) lie are both greater than zero.

3. The electro-hydraulic riveting tool according to claim 1, wherein, the cylinder body (2) is connected to an oil distributing plate (21) in a seamed manner; an end face of the shock-absorbing joint (16) facing the cylinder body (2) is provided with a limiting outer rim (22); an opening of the axial oil duct (17) is disposed on an end face of the limiting outer rim (22); there is provided a limiting groove (23) for accommodating the limiting outer rim (22) on a side of the oil distributing plate (21) opposite to the adapter plate (12).

4. The electro-hydraulic riveting tool according to claim 3, wherein a sealing end piece (24) is provided at an end of the shock-absorbing joint (16) opposite to the limiting outer rim (22); the sealing piece (24) forms an interference fit with the accommodation groove (15); the radial oil duct (18) is disposed between the sealing end piece (24) and the limiting outer rim (22).

5. The electro-hydraulic riveting tool according to claim 1, wherein at the radial oil duct (18) opening on the shock-absorbing joint (16) sidewall, annular sealing grooves (25) for placing sealing rings are provided on both the front and rear axial sides of the shock-absorbing joint (16).

6. The electro-hydraulic riveting tool according to claim 1, wherein the broken-nail guide tube (10) is disposed coaxially with the hollow piston shaft (3); on an outer wall of the broken-nail guide tube (10), there is a blocking plate (26) for blocking a rear end of the rear end cover (4); a buffering section (27) of the broken-nail guide tube (10) is provided with buffer structures adjacent to the blocking plate (26); at an end of the buffering section (27) away from the blocking plate (26), there is an annular groove (28) for inserting an annular retaining ring; with the adapter plate (12) mounted on the broken-nail guide tube (10), the adapter plate (12) is positioned in a middle of the buffering section (27); the buffer structures are provided between the adapter plate (12) and the blocking plate (26) as well as between the adapter plate (12) and the annular groove (28).

7. The electro-hydraulic riveting tool according to claim 6, wherein each buffer structure an elastic gasket (29) and an elastic ring (30) arranged at intervals; the elastic gasket (29) has a rectangular cross-section, while the elastic ring (30) has a circular cross-section.

8. The electro-hydraulic riveting tool according to claim 6, wherein, a support frame (31) for supporting a guide rod is provided for breaking nails on a side of the pump body (35) adjacent to the nail-collecting box (11).

9. The electro-hydraulic riveting tool according to claim 8, wherein, the adapter plate (12) is provided with a front guide ring (32) for the passage of the broken-nail guide tube (10); an inner diameter of the front guide ring (32) is equal to an outer diameter of the buffering section (27); the support frame (31) is provided with a rear guide ring (33) for the broken-nail guide tube (10) to pass through; an inner diameter of the rear guide ring (33) equals an outer diameter of the broken-nail guide tube (10), and the outer diameter of the buffering section (27) is greater than that of the broken-nail guide tube (10).

10. The electro-hydraulic riveting tool according to claim 1, wherein an end-face protective sleeve (34) is provided on an end face of the broken-nail guide tube (10) facing the nail-collecting box (11).

* * * * *